US006899034B1

(12) United States Patent
Glover et al.

(10) Patent No.: US 6,899,034 B1
(45) Date of Patent: May 31, 2005

(54) CONTROLLED ENERGY RELEASE PROJECTILE

(76) Inventors: Charles H. Glover, 4845 Calico Rd., Lenoir, NC (US) 28645; Susan O. Hartley, 4845 Calico Rd., Lenoir, NC (US) 28645

( * ) Notice: Subject to any disclaimer, the term of this patent is extended or adjusted under 35 U.S.C. 154(b) by 11 days.

(21) Appl. No.: 09/721,062

(22) Filed: Nov. 22, 2000

Related U.S. Application Data

(63) Continuation-in-part of application No. 09/107,892, filed on Jun. 30, 1998, now abandoned.

(51) Int. Cl.[7] ..... F42B 7/00; F42B 7/04

(52) U.S. Cl. ..... 102/457; 102/451; 102/453; 102/456; 102/461; 102/462; 102/501; 102/502; 102/506; 102/532

(58) Field of Search ..... 102/398, 438, 102/439, 448–463, 491, 501, 494–496, 502, 506–510, 513–519, 522, 532, 529

(56) References Cited

U.S. PATENT DOCUMENTS 1,941,336 A * 12/1933 Barbieri ..... 102/457
3,911,820 A * 10/1975 Canon ..... 102/438
4,471,699 A * 9/1984 Turco et al. ..... 102/501
4,913,054 A * 4/1990 Petersen ..... 102/439
5,293,822 A * 3/1994 Peddie ..... 102/506
5,596,167 A * 1/1997 Davis ..... 102/532
6,067,909 A * 5/2000 Knoster, Jr. ..... 102/517
6,257,147 B1 * 7/2001 Davies ..... 102/506

* cited by examiner

*Primary Examiner*—Michael J. Carone
*Assistant Examiner*—James S. Bergin
(74) *Attorney, Agent, or Firm*—Jagtiani + Guttag

(57) ABSTRACT

A projectile is provided, in accordance with the present invention that includes a gas seal, a wad absorption zone, a core hull, a mass of projectile core particles within the hull and an actuator member. The hull is a cylindrical member having an open end and made from a material, such as soft plastic, that is characterized by the ability to peel back upon itself on impact, thereby releasing the mass of core particles after impact. The actuator, is releasably fixed to the hull open end, has an exterior side and an interior side and one or more stem members projecting into the mass of core particles. Upon impact, the actuator is released from the hull open end and continues to be propelled forward, along with the core particles. When the projectile impacts a target, the hull peels backward upon itself thereby releasing the actuator and the mass of projectile core particles.

16 Claims, 9 Drawing Sheets

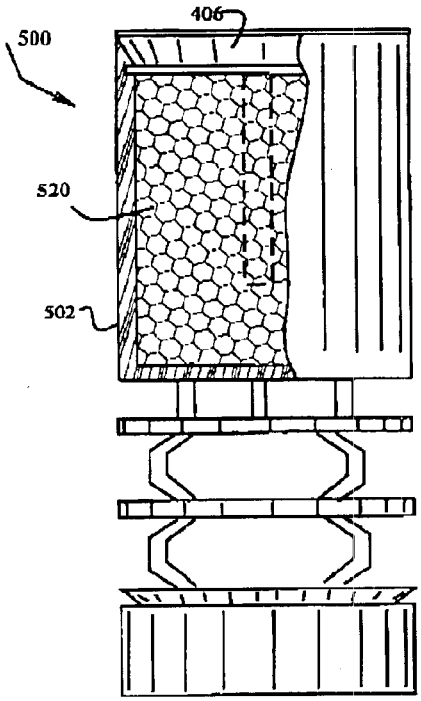
Figure 7
Figure 6
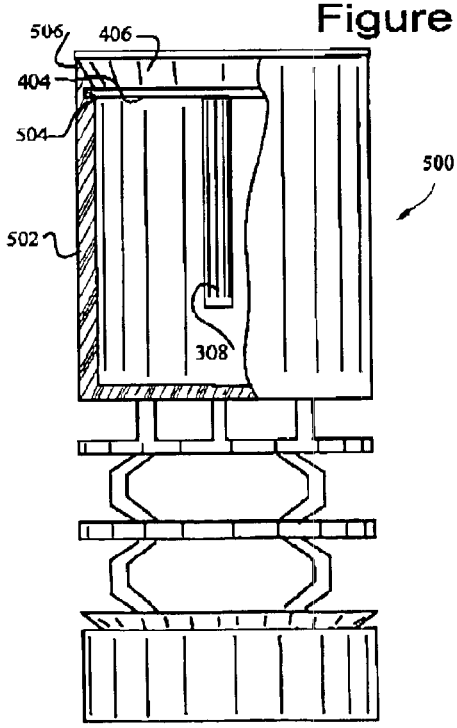
Figure 5
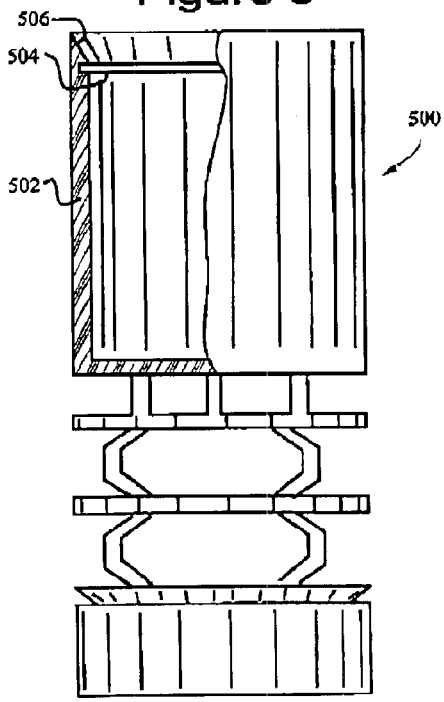

Figure 11
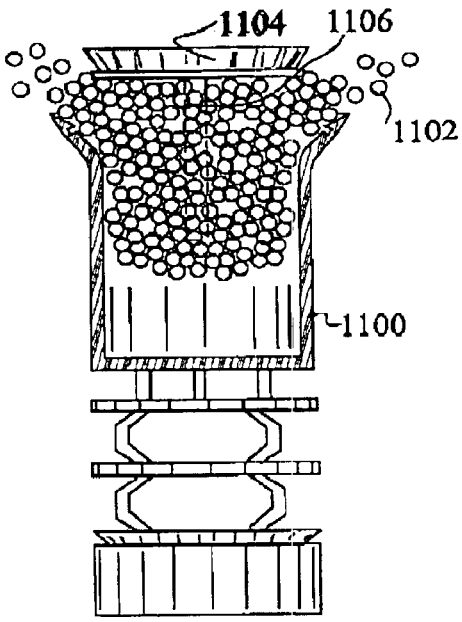
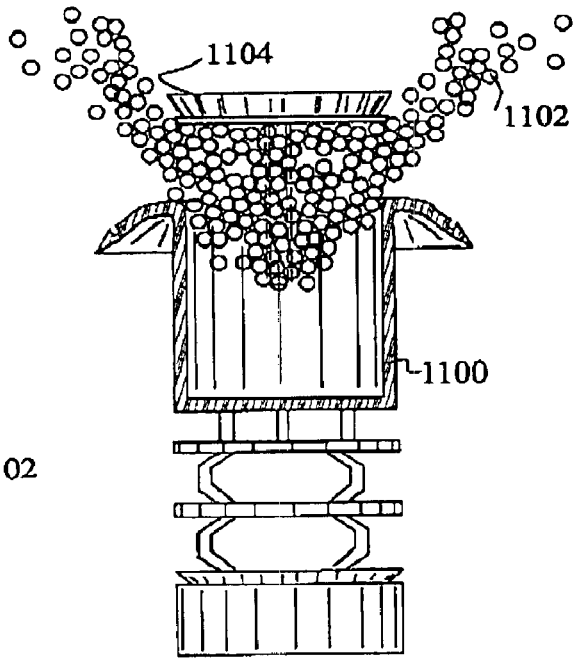
Figure 12

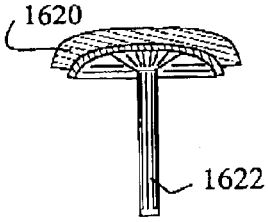
Figure 22
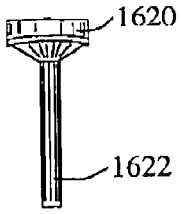
Figure 23
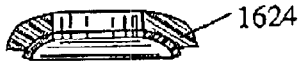
Figure 24
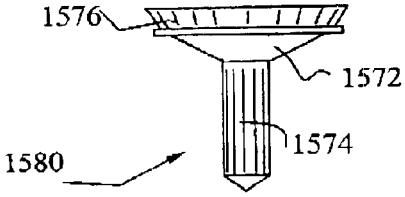
Figure 17
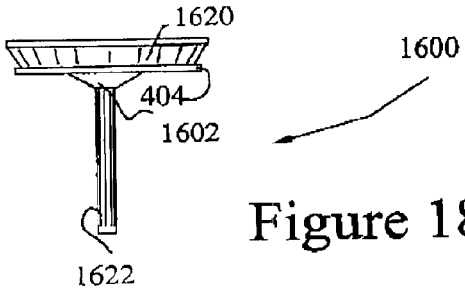
Figure 18
Figure 16
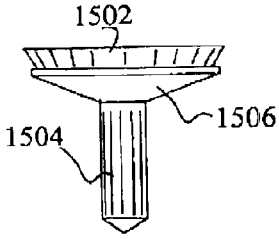
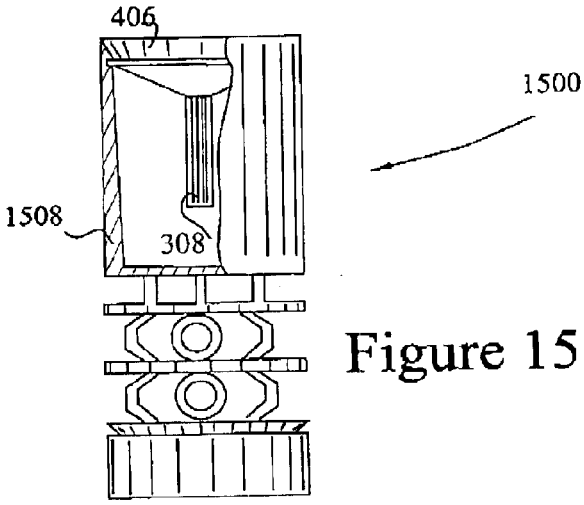
Figure 15

CONTROLLED ENERGY RELEASE PROJECTILE

CROSS-REFERENCE TO RELATED PATENT APPLICATIONS

This application is a continuation-in-part of U.S. patent application Ser. No. 09/107,892, filed Jun. 30, 1998, abandoned, the disclosure of which is incorporated herein by reference, as though recited in full.

BACKGROUND OF THE INVENTION

1. Field of the Invention

The present invention relates to a fragmentation type projectile for antipersonnel use, and more particularly, to a fragmentation type projectile having increased stopping power and after initially hitting a target, having a decreased lethal range.

2. Brief Description of the Prior Art

The problems associated with ammunition missing, or going through the target, and hitting an innocent bystander has long been acknowledged. Various methods of resolving the problem have been approached, however none have eliminated the inadvertent injuries and deaths.

Various forms of smooth bore shotgun projectiles, specifically buckshot and slugs, originally designed for use in hunting big, and/or dangerous game animals, are well known in the art. Although these designs are the most common types of shotgun ammunition used by the law enforcement community, their excessive destructive capabilities have always presented liability problems in law enforcement situations.

These projectiles are designed for deep penetration in game animals weighing up to one thousand pounds. With only a fractional loss of energy, they will completely penetrate a human sized target. The small percentage of energy transference to the target make these hunting projectiles very inefficient, and dangerous for use in crowded urban environments. Both slugs and larger sizes of buckshot are capable of passing through multiple residential type interior walls, and/or non-masonry exterior walls, while retaining lethal energy.

Shotgun projectiles have been designed typically to have either a single projectile, or core element (slug), or multiple projectiles, or core elements (shot or pellets). In the multiple projectile, or core element design, a shot cup or hull protects the projectiles from deformation inside the shotgun barrel and upon exit from the barrel separates from the core elements prior to impact.

Typically, this shot cup or hull is slit and peels back during flight, due to wind resistance. The pellets then travel in a progressively spreading pattern and impact a target as a collection of individual particles whose impact area is dependent upon the distance the pellets have traveled.

A target struck by small, less dangerous multiple individual pellets receives very little post impact trauma or blunt trauma injury, as the individual pellets displace minimal kinetic energy, which is lost rapidly during flight or upon the first impact. By way of contrast, a slug and to a lesser extend large buck shot, generally hits with enough kinetic energy and penetration to produce blunt trauma injury, over penetration of an initial target and lethality for an extended period of travel beyond. The difficult problem of achieving a balance between the safer, small and inefficient individual pellet impact and the dangerous, but effective slug impact, is not only achieved by the process and projectile of the present invention, but is achieved in a controlled manner.

The disclosed unique type of projectile will penetrate an initial barrier, create a secondary incapacitation zone of several feet or greater if so desired, and then become non-lethal down range. It is through a controlled expansion process that the present ammunition achieves a result that is different from any ammunition ever designed.

BRIEF DESCRIPTION OF THE DRAWINGS

The objects and advantages of the invention will become apparent from the following description of the invention, particularly when read in conjunction with the drawings, in which:

FIG. 5 is a side elevation view, partly in section, of a further embodiment of a projectile in accordance with the present invention;

FIG. 6 is a side elevation view, partly in section, of the embodiment of FIG. 5, shown with the actuator of FIG. 4 positioned within the hull;

FIG. 7 is a side elevation view, partly in section, of the embodiment of FIG. 5, shown with the actuator of FIG. 4 and core particles positioned within the hull;

FIG. 11 illustrates an initial stage in which core particle mass are bundled behind an actuator, and illustrates a pressure wave preceding the actuator;

FIG. 12 illustrates a subsequent stage in which the core particle mass of FIG. 11 have begun to spread, and showing the actuator preceded by a pressure wave that has diminished as compared to the stage shown in FIG. 11.

FIG. 15 is a partial cut away view of a hull embodiment having tapered walls;

FIG. 16 is a side view of an actuator in accordance with the disclosed invention;

FIG. 17 is a side view of another actuator embodiment with the cone having a smaller angle;

FIG. 18 is a side view of an alternative actuator embodiment having a small angled cone;

FIG. 22 illustrates the actuator of FIG. 18 undergoing controlled failure;

FIG. 23 is a side view of the actuator of FIG. 22 after separation of the actuator ring;

FIG. 24 is a side view of the separated actuator ring;

SUMMARY OF THE INVENTION

Figure 1:
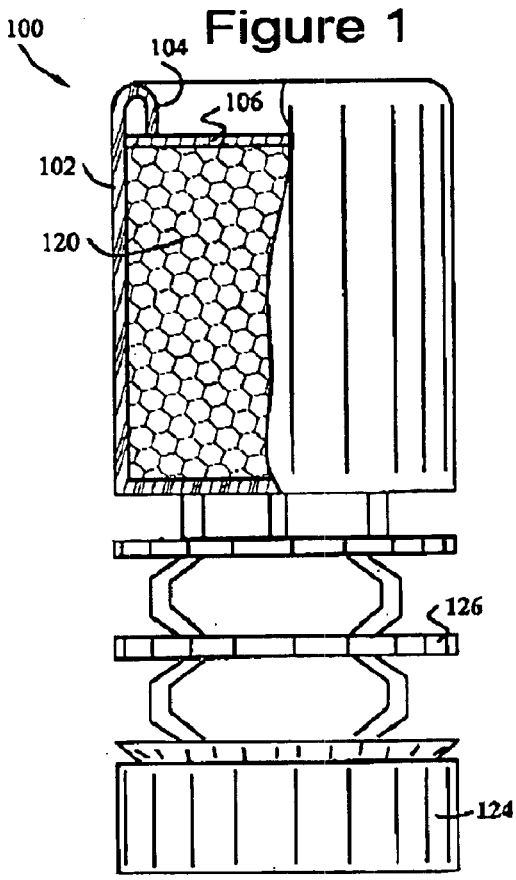
FIG. 1 is a side elevation view, partly in section, of a projectile in accordance with the present invention.

A projectile is provided, in accordance with the present invention that includes a gas seal, a wad absorption zone, a core hull, a mass of projectile core particles within the hull and an actuator member.

The hull is a cylindrical member having an open end and made from a material, such as soft plastic, that is characterized by the ability to peel back upon itself on impact, thereby releasing the mass of core particles after impact. The actuator, is releasably fixed to the hull open end, has an exterior side and an interior side and one or more stem members projecting into the mass of core particles. Prior to impact the actuator maintains the core particles within the hull. Upon impact, the actuator is released from the bull open end and continues to be propelled forward, along with the core particles. The actuator member is at the lead or impact end of the projectile and the absorption zone is at the trailing end, upstream of the core particles.

The core particles have a diameter substantially in the range from about 0.01 of an inch to about 0.13 of an inch and preferably in the range from about 0.02 of an inch to about 0.05 of an inch for a controlled lethality zone. The particles are very fine and individually do not inflict a lethal wound.

The hull preferably has an internal channel proximate its open end that interacts with a peripheral, circular ring mounted on, or integral with, the actuator. In the preferred embodiment, the actuator has a truncated conical section having tapered sides. The actuator is positioned within the hull internal channel such that its tapered sides have its greatest radial dimension at its exterior side. The actuator's circular ring is positioned on the interior side of the truncated conical section of the actuator.

The process involves igniting an explosive charge thereby projecting the projectile along a substantially straight trajectory. The explosive charge impact is absorbed thus preventing the core particles from compressing into a unified structure that will not disperse into individual fragments.

The disclosed projectile design travels as a unified unit, with the hull and contents remaining intact until impact. This is the complete reversal of the action of the shot cup or hull and core particles in typical shotgun shells. In the prior art, the wad, shot cup combination peels away and does not travel along with the core particles, let alone contain the particles. The particles fan out and travel along an elongated path. The target is thus impacted by a large number of individual spaced apart particles. The particles are spaced apart both in a fan like manner, and like a train. To the extent that particles continue to travel along the same path, the impact is like the first car of the train hitting., followed in time by the second car, then the third car, etc. The multiple individual impacts have less penetration power and energy transfer than a unified slug.

In the present invention the core particles are contained within the hull until a target is impacted by the projectile. When the projectile impacts a target, the hull peels backward upon itself thereby releasing the actuator and the mass of projectile core particles. The peel back of the hull must be at a rate equal to the velocity of the travel of the pellets thereby causing the core particles to be released essentially simultaneously. The essentially simultaneous release of the particles serves to maintain the pellets as an integrated, uniform, co-acting unit.

The forward movement of the actuator and mass of tightly grouped projectile core particles creates a pressure wave and subsequent trailing low pressure area that serves to maintain the core particles in a confined zone behind the actuator.

The actuator and pressure wave initially maintains the projectile core particles in a confined zone behind the actuator for a controlled, predetermined distance. The example used herein uses distances of up to about ten feet, but preferably about three feet, changing the actuator, core particle size and hull can change the distances. Within the confined zone the mass of projectile core particles have a lethal impact effect substantially equivalent to that of a unitary projectile, and substantial penetration force. By acting as a unitary mass, the pellets impact a target in a manner analogous to that of a large diameter slug.

Beyond the confined zone, the projectile core particles travel in a progressively expanding pattern such that the particles travel as substantially discrete individual particles and upon impact with a secondary target produce a plurality of non-lethal individual impacts.

DESCRIPTION OF THE PREFERRED EMBODIMENTS OF THE INVENTION

The law enforcement requirements for tactical ammunition are extremely specific and appear to be mutually exclusive. First, the ammunition must be capable of incapacitating an individual upon initial impact as quickly as possible. Second, it needs to do so with either a direct impact, or after passing through a barrier, such as a car windshield, a residential partition wall, or a residential door, used by the criminal as a shield. However, as a third requirement, it needs to pose as little threat as possible to innocent bystanders or people down range from the shooting position. For example, if a round is fired in an apartment building, the round must not endanger residents in neighboring apartments.

Conventional ammunition with a solid lead design, or with a solid lead core and a copper jacketing material, meets the first requirement reasonably well. This type of ammunition can be configured in an expanding design that will impart a fair amount of energy through the expansion process. This energy generally incapacitates the target upon impact. It meets the second requirement extremely well in that it only loses energy through contact resistance and can travel with lethal energy for hundreds of yards after an impact with something as non-resistant as a residential partition wall. The third requirement is where the conventional ammunition design fails, since it is designed to penetrate an initial barrier and retain lethal force beyond, there is a sacrifice of down range safety.

In an effort to create safer designs, ammunition designers have for many years experimented with "pre-fragmented" rounds that contained a plurality of sub-munitions inside a "hull", (typically a copper jacket similar to that on a conventional bullet). In the prior art the design and operation of these rounds fall into one of two groups. The first is designed with loose particles inside the hull or jacket, and bursts into an uncontrolled spray of particles upon initial impact. The second type is comprised of loose particles that have been swaged into a solid mass, or bound together into a solid mass by some type of compound, such as epoxy. This second type of projectile is designed to penetrate solid obstacles, such as partition walls, and only break apart upon contact with a viscous media.

The first type of "pre-fragmented" round is much safer when deployed close to bystanders than conventional ammunition due to the fact that the round bursts into non-lethal particles upon the first impact. This type of round has never met with favor in police work because of its lack of effectiveness when the need arises to shoot through an initial barrier and disable someone on the other side.

The second type of "pre-fragmented" round is more effective in law enforcement scenarios but can be just as dangerous and prone to over penetration as conventional ammunition if it takes flight through a house, apartment or business complex.

The present invention provides for the unique combination of the full impact of a unitary structure while providing for radial dispersion of the impact energy. This is accomplished in three stages. The first stage is a forceful initial impact similar to that of a solid slug. The second stage is a short secondary zone, downstream of the point of initial impact, in which the projectile particles are lethal, but have slightly reduced penetration and a broader blunt trauma zone than that of standard tactical shot gun ammunition. In the third stage the particles have succumbed to air resistance and have become non-lethal or harmless.

The projectile converts upon an initial impact from (1) a unitary structure to (2) an expanding body of individual particles that continue to act as a unitary structure and (3) within a controlled distance, becomes a mass of discrete particles that rapidly lose their ability to injure. Stated another way, the projectile (1) initially acts like a slug, then (2) acts like a slug of substantially increased diameter and then (3) becomes a non-lethal object.

The increased diameter of the projectile after initial impact and unified formation of the core particles produces an impact comparable to that of a very high caliber projectile. The disclosed projectile, when the initial impact and expansion is within a body, produces a wide pressure or shock wave that can produce a lethal and immediately incapacitating impact upon organs. Incapacitation is critical in tactical situations, as for example in interaction with terrorists the need is to disable the terrorists immediately before they can react with deadly consequences.

In order to instantaneously incapacitate a terrorist it is essential that the projectile expand rapidly enough to completely decelerate within the internal organs, imparting all its energy without over penetration. The forward shock, or pressure, wave that is generated will impact the internal organs in advance of the projectile particles and a rebounding shock wave will impact the organs a second time. The rebounding pressure wave is the original wave reflected off of, and amplified by, the interior surface opposite the point of entry. The core particles will embed into the first surface, such as an organ or tissue, which has a density sufficient to stop their forward movement. This has been demonstrated by firing the projectile into a large plastic container of ballistic gelatin. The projectile blew apart the container without penetrating the rear of the container. The front of the container is considered to be the first side impacted by the projectile and the rear is the opposite side of the container. It has been found that a zone of expansion from first impact to very low potential for lethal impact that is initially seven (7) to ten (10) feet, in free flight, is compressed to seven (7) to ten (10) inches in various viscous materials. In water, full projectile expansion and deceleration occurs within approximately four (4) inches of penetration, in ballistic gelatin approximately seven (7) inches, and in animal tissue and organs seven (7) to ten (10) inches.

A typical round of conventional ammunition can penetrate the body and produce little immediate incapacitation. Byway of analogy, the need is to hit the terrorist with a high velocity bowling ball rather than a high velocity spear. The spear can eventually produce death due to bleeding but would not prevent the terrorist from continuing to function for some limited period of time, perhaps as long as several hours. The wide spread blunt trauma of the bowling ball impact would immediately stop the terrorist from continuing to function. If the terrorist is wearing a bulletproof vest, immobilization can only be achieved by impacting the terrorist with a huge amount of energy over a confined area.

It is also seen that this projectile can penetrate a first barrier and retain its lethal efficacy for a limited distance. The impact on the terrorist also must be such that the terrorist is immediately incapacitated by the blunt trauma impact of the expanding mass of core particles, even though the projectile had penetrated a protective barrier such as a wall or car windshiled. However, in the event that the terrorist provides the first impact object, the projectile must become non-lethal after impacting the terrorist. The limitation of the distance should be such that a terrorist cannot seek shelter directly behind a residential type partition, a wall or a door, but innocent parties who are at a significant distance from the wall or behind a second wall, would not be exposed to danger.

Law enforcement officers are sometimes killed by "friendly fire" when a fellow officer's projectile travels through an auto or partition wall, striking them on the other side with enough force to defeat their body armor. With the disclosed projectile design, after an initial impact the expanding projectile has increased blunt trauma potential but greatly reduced potential for penetration. In its expanding form it may still incapacitate but is much less likely to kill a person wearing body armor standing adjacent to the auto or partition wall. And, since the distance over which the projectile changes from lethal to non-lethal particles, is now pre-designed into the projectile, unprotected people beyond the lethal range of the core particles would only receive slight abrasions if any injury at all.

Since there can be a point of second impact within the lethal zone, the energy must dissipate rapidly subsequent to the second impact such that the particles become non-lethal and that there can be no third lethal impact point at a point distant from the last impact zone.

The operation of the projectile of the present invention is unlike prior technology. As for example, in the case of the original Glasser bullet design, that has a plurality of round particles in a metal jacket, when the bullet hits it bursts immediately into non-lethal particles and there is no secondary lethal zone. The looser the core of particles the greater the dispersion. In the latest Glasser design the core particles are typically swaged to form somewhat solidified slug that can penetrate multiple layers of glass or partition walls and will only break apart into nonlethal particles after impact with viscous material.

Due to the size of the projectile a heavy recoil would be produced using a low burn rate powder to produce a high velocity projectile. Since tests have provided no advantages to using a supersonic velocity, disclosed projectile preferably uses a high burn rate powder that produces subsonic velocity. This lower speed dramatically reduces the recoil while increasing the stability of the projectile in flight.

FIG. 1 is an illustration of a projectile, indicated generally as 100. The overall structure, as for example the gas seal, the wad for absorbing the impact of the firing of the projectile and a core of particles is generally in accordance with the designs and concepts of the prior art. However, the hull or shotcup 102, the actuator 106 and the core particles 120, and the interaction between the various parts are unique to the present invention.

The hull 102 contains the mass of core particles 102 which are contained within the hull 102 by folding over the upper end 104 of the hull 102 to lock the actuator 106 in place. The size of the particles contributes to the effectiveness of the disclosed projectile. The use of fine particles is essential to change a secondary impact from lethal to non-lethal in a short distance.

The hull of the disclosed projectile must have some expansion capabilities, however to great an expansion and the release is uncontrolled. Insufficient expansion will cause the projectile to rupture or tear rather than peel back. The preferred material is a low density polyethylene, low mold grade, or a material having equal performance.

As can be seen in the Figures, the projectile 100 is a single piece unit, which makes the material selection critical. The base 124 provides the gas seal and is exposed to about 8000 psi gas pressure upon firing. The crush section 126 must be able to withstand the impact force during firing and return to its expanded position. The hull 102 must have the ability to be configured to affect a controlled peel back. The one material must meet the foregoing three very different responses in order for the disclosed projectile to perform as described.

The individual, fine particles do not have penetration power as individual particles and are rapidly slowed down by air resistance. To prevent the core particles 120 from compressing into a unified body that would resist separation upon impact, a conventional wad absorption zone is used to absorb the initial force of the gun power.

Maintaining the projectile as an integrated or unified acting body of expanded diameter is achieved through the use of the actuator. The actuator also serves to dam up the particles and keep them confined within the hull 120. The actuator is preferable a thumb-tack like structure that keeps the individual particles from immediately spreading directly after an initial impact and becoming ineffective with respect to being able to render a terrorist incapacitated. The actuator works in conjunction with the hull to produce a three stage transition from a slug, to a wide diameter blunt trauma producing object and then to non-lethal individual particles.

Figure 21:
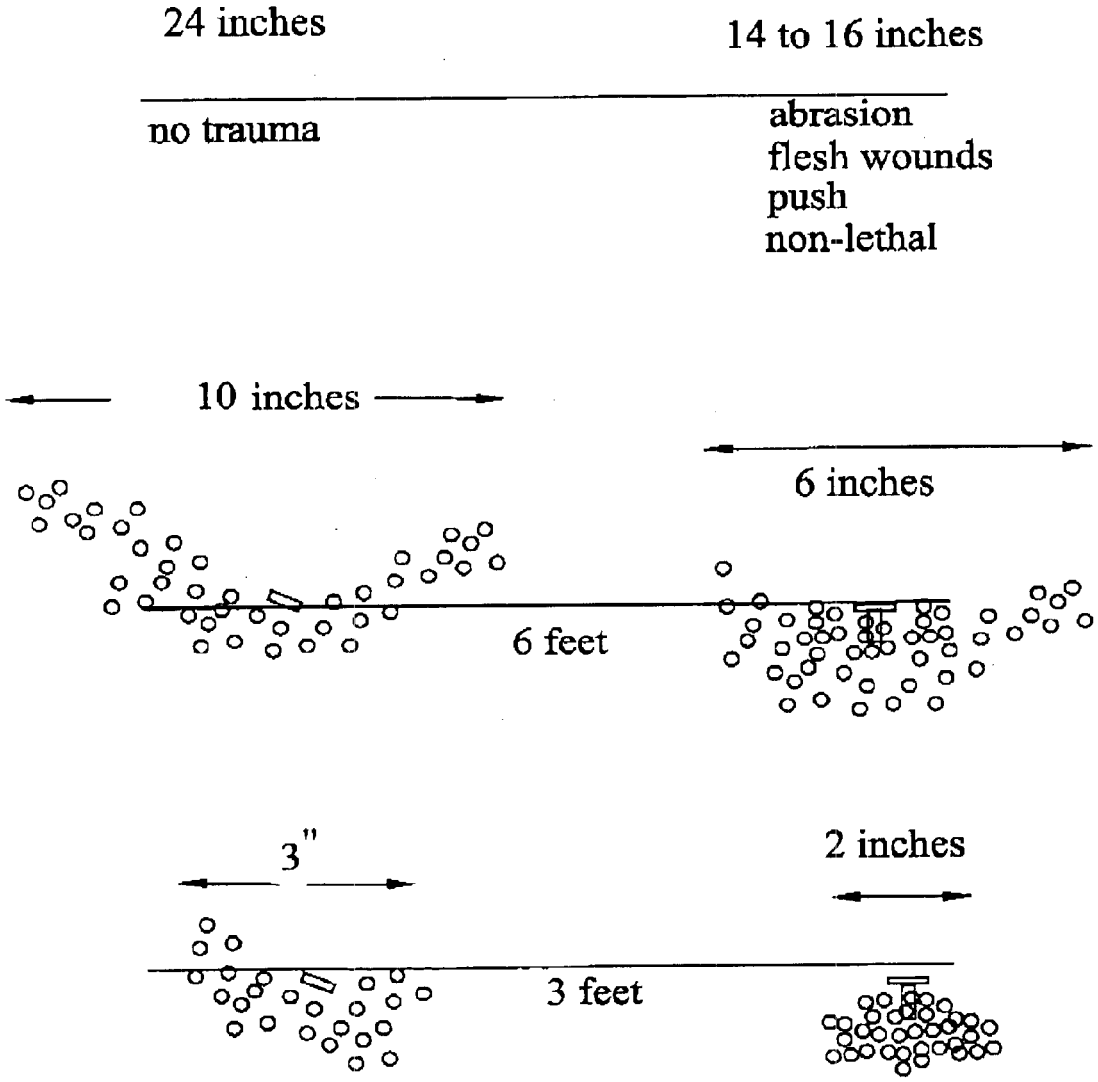
FIG. 21 is a graph comparing the core particle spread using an actuator having a stem to an actuator without a stem.

In FIG. 1, the actuator 106 does not contain a stem which, in some uses where controlling the lethal range is not critical, is advantageous. In most applications, however, the stem provides necessary stability to the actuator. As seen in FIG. 21, the core particles 2100 follow behind the actuator 2102 when the stern is present to provide a stable flight. When an actuator 2112 without a stem is used, the core particles 2110 expand outwardly as the actuator 2112 tips.

After an initial impact, the actuator maintains the particles as a unified body of increased diameter but still traveling as an integrated body over the predetermined distance of the secondary zone. If the particles spread randomly, or too quickly, impact can be that of hundreds or thousands of minute, non-lethal particles thereby negating the desired trauma effect of the secondary impact zone. Through the use of controlled expansion, the particles impact over a confined area, comparable to that of a very large caliber projectile. The term "very large caliber projectile" is intended to indicate that the effective diameter of the projectile is increased by a factor of at least two and preferably, at least four. Since surface area of a circle increases with the square of the radius, the doubling of the diameter or caliber increases the impact area four fold.

When the pressure wave dissipates, at approximately four to five feet from core particle release, the motion of the actuator 106 is resisted by air resistance, and the particles disperse around the actuator. Radial dissipation of energy is the net result. The lethal zone is thus reduced from 300 feet, for conventional ammunition, to about three (3) feet in the disclosed design. It is possible to shoot through a wall, door, metal sheet, etc, with the lethal force carrying over to immediately downstream of the initial penetration for roughly three feet. Therefore, although a criminal proximate the door would be struck with debilitating force, a neighbor in an adjoining apartment would not be endangered.

The particles 120 must be discrete particles such that the mass fragments into individual minute particles. Because of the versatility of the disclosed projectile, the size of the core particles is dependent upon the end use. As disclosed herein, the core particles have a lethal range of less than seven feet. Because of this short range, the particle sizes is preferably in the range from about 0.01 inch to about 0.13 inch. Most preferably, the range is from about 0.02 inch to about 0.05 inch. The small size and mass of the individual particles causes them to have a short flight path when exposed to air resistance.

To provide the controlled lethal range described herein, the core particles must be spheres, remaining separate from one another. The use of flake power rather than spherical core particles causes the interior particles to swage together under the pressure of the impact, creating a solid mass that penetrates and precedes down range from an intial impact, similar to a slug.

To increase the lethal range, the particle size is increased, along with actuator angle adjustments. To increase the lethal range to about thirty (30) feet, the size of the particles would be increased to about 0.13, along with a reduction of the angle of the actuator cone.

Figure 2:
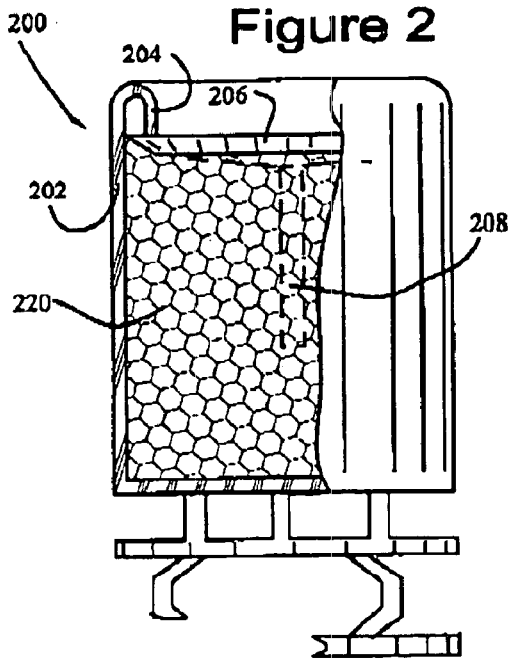
FIG. 2 is a side elevation view, partly in section, of another embodiment of a projectile in accordance with the present invention.
Figure 3:
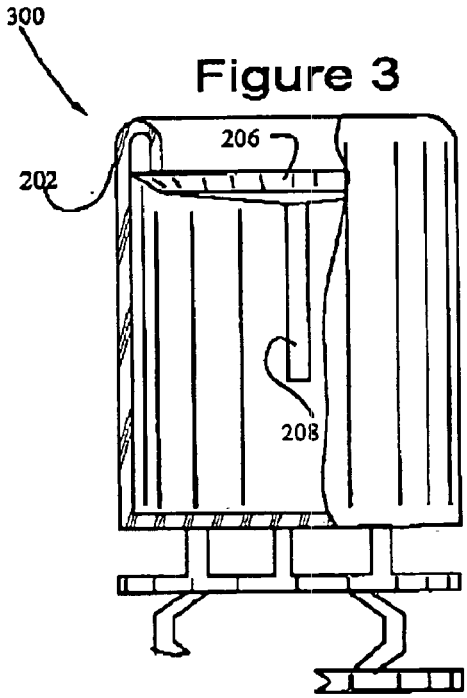
FIG. 3 a side elevation view, partly in section, of the projectile of FIG. 2, shown without the core particles.

FIG. 2 illustrates an alternate embodiment in which the actuator 206 has a thumb tack like shape. The projectile 200 is otherwise essentially the same as in the prior embodiment. The hull 202 has a folded over end 204 that holds the actuator in place and the hull 202 is filled with thousands of discrete particles 220. In FIG. 3 the projectile 200 is illustrated without the core particles 220 and the stem 208 of the actuator 206, is thus visible.

It is preferable in all embodiments that the end of the actuator be pointed. Although this is not a necessity for performance, it makes the insertion of the actuator into the hull filled with core particles easier. The length of the actuator stem must be about ⅔ of the length of the hull. At about the ⅓ point the actuator becomes unstable during flight since there is too little contact with the core particles. At a length substantially greater than ⅔ the stem will contact the hull base during the compression upon impact. Even if the stem does not punch a hole in the base of the hull, the impact will throw the actuator out of alignment during flight.

Figure 4:
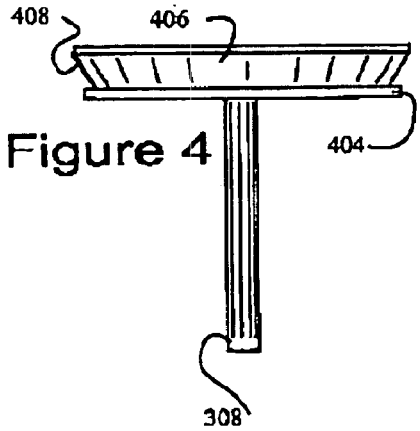
FIG. 4 is a side view of an actuator of the present invention.

An alternate embodiment of an actuator 406 is shown in the enlarged view of FIG. 4. The actuator 406 has a circular flange 404 that locks into the circular channel 504 in the upper end of the projectile 500 hull 502, as illustrated in FIG. 5. The tapered side 408 of the actuator 406 form a frusta-conical shape that is based on the circular flange 404. The open end of the hull 502 has a tapered top wall 506 that is configured to match the tapered side 408 of the actuator 406.

In FIG. 6 the actuator 406 has been placed within the projectile 500. It can be seen in this Figure how the tapered side 408 of the frustro-conical section mated against the tapered wall 506 of the hull 502. Similarly, the circular flange 404 of the actuator 406 is shown locked into the circular channel 504. The projectile 500 is illustrated fully assembled in FIG. 7 wherein the core particles 520 have been sealed within the hull 502 by the actuator 406. The actuator 406 has a cap 504 that has a diameter equal to that of the hull 502 thereby causing the cap 504 to rest on the rim of the cylindrical portion of the open end of the hull 502. This overlap serves to prevent the actuator 406 from angling or shifting during insertion. The cap 504 further prevents the actuator 406 from sinking into the hull 502 and bringing the stem 408 beyond the functional depth.

Figure 20:
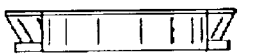
FIG. 20 is a side view of the outer ring resulting from the controlled failure of FIG. 19.
Figure 19:
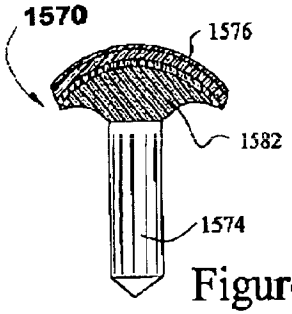
FIG. 19 is a side view illustrating the controlled failure of the actuator of FIG. 16 or 17.

The projectile must produce essentially the same results when passing through steel plate, a car door, a car windshield or a residential interior wall or exterior wall. It has been found that when the actuator impacts a very rigid surface, such as a substantial gage metal plate, the actuator head 1570 will, as illustrated in FIGS. 17, 19–20, enter into a controlled failure, curving back or cupping, upon penetration of the metal. In this manner, the core particles are maintained in a dense cluster and provide greater penetration power than if permitted to disperse laterally. At the moment of penetration between the forward momentum of the core particles pushing forward against the inside curvature 1582 of the actuator 1570 and the metal being penetrated resisting against the outside curvature 1584 of the actuator 1570, a shearing effect occurs. This affect removes a ring of plastic 1584 from the outside edge of the actuator 1570 as the rest of the actuator 1570 (FIG. 19) and core particles punch through. This is known as a controlled failure because the reduction in the diameter of the face of the actuator 1570 makes penetration easier and enough of the interior angle remains intact to facilitate the proper spread of core particles into the second and third phase of their flight. To achieve this the actuators are preferably manufactured from a high-density polyethylene, or its equivalent. The material must have a combination of rigidity and toughness to punch through residential type partitions, walls, doors, car windshields and bone without breaking or tearing yet be flexible enough to enter into controlled failure upon impact with a dense obstacle. The use of an extremely hard material, such as polycarbonate, prevents the actuator from entering into the controlled failure illustrated. As illustrated in FIGS. 22–24, using material that is too soft, or a stem that is too narrow, enables the stem and particle to punch through the actuator face, leaving a large, free floating ring.

The penetration power required to pass through sheet rock, that is, a residential interior wall, for example, is less than that required to penetrate the metal plate and the actuator would not deform as in the case of penetration through the metal plate.

The initial transformation of a unitary slug to a unified projectile of increasing diameter is achieved by rapidly separating the plurality of unified particles from the housing within which they are contained. If the separation step from the housing, or hull, is too slow, then the particles will spread too slowly and will continue to function as small diameter penetrating projectile and will continue to have too much penetration capability and thus continue to be lethal, over an extended distance. If the expansion is too rapid, then the particles lose their incapacitating force too rapidly, eliminating the capability to incapacitate a terrorist standing behind a wall or protected by a car windshield.

To control the transformation the hull is tom away from the particles at a predetermined rate, thus producing a predetermined rate of expansion of the path that the particles follow subsequent to the initial impact of the projectile with an object. The controlled separation of the particles from the hull can be achieved by peeling the hull back upon itself as a result of the contact of the hull with an object having a predetermined density. The peel back rate of the hull must be controlled so as to release the particles within, preferably, about from 0.0005 to 0.001 seconds. This would occur upon penetration of a typical residential partition wall, wooden wall or car windshield.

By way of further contrast with the prior art projectiles, in the present invention, the hull travels with the contained core materials until impact, peeling back upon impact to free the core particles. The amount of resistance necessary for the hull to peel back is very low. Although automobile, safety glass or gypsum board will produce peel back, single pane window glass will not produce peel back. A sheet of cardboard, a corrugated box, a sheet metal panel, a plastic container filled with water, flesh and body organs, are all within the category of materials that will produce the peel back effect. A sheet of paper is typically insufficient to produce the peel back of the hull.

If peel back occurs cleanly, all lead core particles leave as a single mass and fly that way for some distance, up to about several feet in open air. For the first two to three feet, the core particles have a single body effect. The core is continually expanding and about 3 to 6 feet later the lethal effect of the core decreases substantially. Up to about a four inch diameter the core particles produces an impact comparable to that of a single slug. A ten inch diameter for the zone of the core particles, produces thousands of individual particle impacts and consequently is far less lethal.

Figure 8:
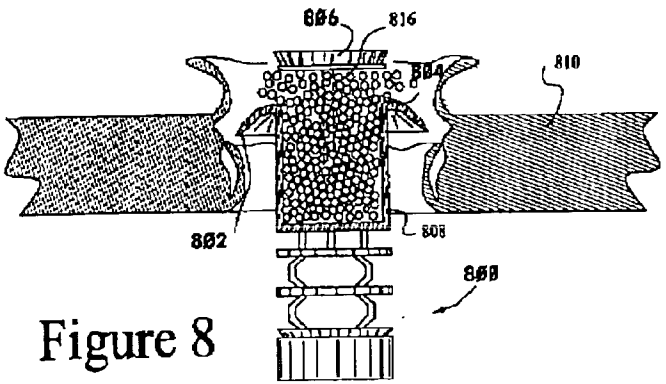
FIG. 8 is a side elevation view, partly in section, of the embodiment of FIG. 7, shown after an impact with a target, and showing the initial peel back of the hull.

FIG. 8 shows a projectile 800 penetrating a shielding target 810, as for example a car window, a door or even a relatively viscous mass. The hull 808 begins to peel back and the core particles 804 begin to become free of the containment by the hull. The core particles 804 and the actuator 806 are, as the hull open end 802 is peeled back, released as a core unit from their containment within the hull 808. If the hull peels back progressively, the core particles are released progressively. If the hull immediately disintegrates, the pellets disperse in an uncontrolled manner and the core particles immediately lose their capacity to be lethal.

Figure 9:
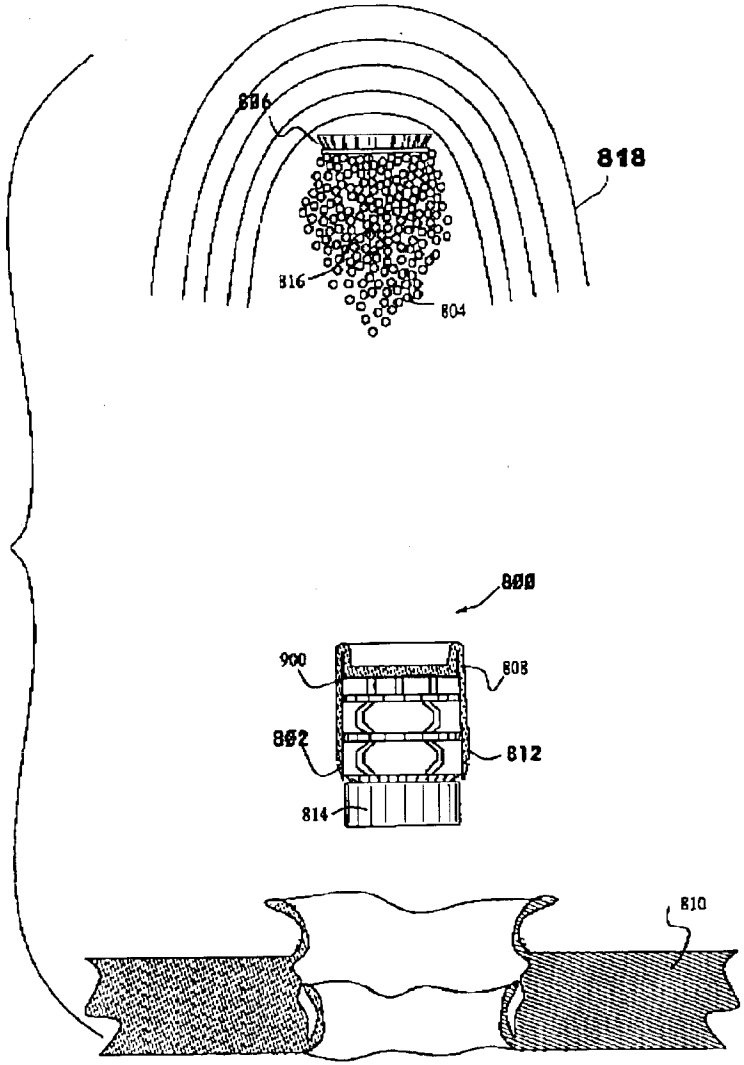
FIG. 9 is a side elevation view, partly in section, of the embodiment of FIG. 8, shown the hull fully peeled back, the core particles and actuator separated from the hull, and the actuator preceded by a pressure wave.

FIG. 9 shows the projectile 800 leaving the shielding target 810 with the hull upper end 802 peeled back upon the crush zone 812. The peeled back section of the hull 808 can be peeled back to the point where the upper most edge 802 extends all the way to the projectile end 814. That is, the projectile 800 can be folded fully upon itself. The peel back must approximate the rate of travel of the core particles, (projectile velocity) in order to obtain the controlled core particles release illustrated in FIG. 9. With a controlled release, the particles remain clustered and continue to function as a unitary mass, with the exception of a slightly greater diameter than when contained within the hull and of the actuator 806. The core particles are seen to spread over a region of greater diameter than the diameter of the actuator 806, but still are substantially within a unitary grouping.

When passing through a solid or viscous object, the hull 808 peels away and actuator 806 and core particles 804 continue on a forward trajectory along a radial dispersion path. The orientation of the actuator 806 is maintained consistent due to the interaction between the core particles 804 and the stem 816. The stem 816 cannot deviate substantially from the initial path, since the core particles 804 surround the stem 816 and restrict the movement of the stem 816 other than along a path along the stem's axis. The core particles 804 disperse radially, and start losing their lethal force after about three feet (one meter) from the point of initial impact. Thus the core particles initially impact as a cohesive, unitary body and rapidly disperse radially to the point where they are non-lethal individual particles. The unitary core particles can punch through steel plate 1/16 of an inch thick, but after about three feet of travel have degraded into individual non-lethal particles that are traveling in diverse directions, with little forward momentum.

As the hull 808 folds back, the actuator 806, followed by the core particles 804, is released and continues the forward momentum. The mass of the core particles 804 begins to elongate and spread, but remains behind the actuator 806.

For the first three to four feet of travel after core particle release, a pressure wave 818 precedes the actuator 806 and mass of core particles 804 and produces a low pressure area around the actuator and mass of core particles. Thus the actuator 806 encounters little wind resistance, even though it presents a broad, flat surface.

In the first few feet of flight the blunt design of the actuator results in its being dragged along behind the pressure wave 818. Individual particles have a low resistant to air and thus would not produce this pressure wave effect, or be pulled by the vacuum zone produced by the pressure wave. Thus, when the actuator is preceded by a pressure wave, the discrete particles follow the actuator and act as a cohesive mass. Usually within seven to ten feet from release from the hull the pressure wave dissipates, and the actuator's blunt shape causes it to offer high resistance and slow down and/or deviate from its straight-line trajectory. The particles at that point disperse radially to the point where they do not impact as a unitary mass, but rather impact as non-lethal individual particles.

Figure 10:
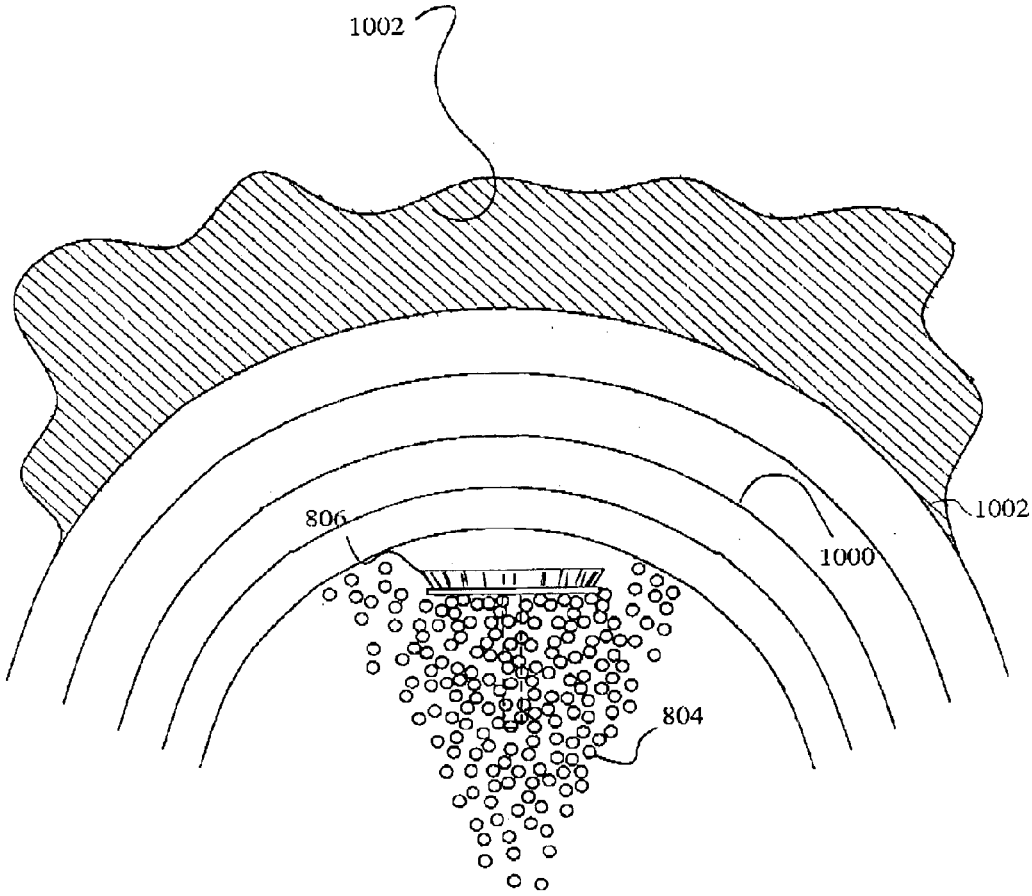
FIG. 10 is a side view of the core particles and actuator of FIG. 9 impacting a secondary region of a target.

This pressure wave effect is dramatically amplified within highly viscous material such as the internal organs of the human body, and becomes a highly destructive force in and of itself. FIG. 10 illustrates the effect of the disclosed projectile when the primary and secondary impact area is a body. As seen herein, the pellets 804 are preceded by a broad, essentially flat pressure wave represented by lines 1000 and thus impact the secondary target 1002 of an organ, over a wide area. The pressure wave 1000 impacts the surface 1004 of the secondary target 1002; driving the surface 1004 away from the advancing actuator 806 and mass of core particles 804.

The force of the pressure wave 1000 can cause a severe trauma over a very large area and can virtually liquefy a body organ. Thus, the effective impact area is substantially larger than the area of the actuator 806 or the mass of core particles 804.

The point of initial impact determines the damage done to a body upon impact by the actuator and core particles. If the initial impact is through a car window or partition wall and the body is hit, within about three (3) feet from the initial impact, the actuator and particles will penetrate the skin and organs nearer the surface and deliver a heavy blunt trauma impact. If, however, the initial impact is through a wall and the body is ten (10) feet beyond the point of exit, the damage will be minimal, if any.

When the initial impact is a body, the peeling back of the hull and release of the core particles takes place within the flesh and the actuator and core particles go on to penetrate the internal organs. Because of the density of the body, the core particles are slowed much faster, therefore remaining within the body. This prevents any accidental injuries due to a bullet passing through the body of initial impact and hitting a second person. Additionally, because of the viscosity of the internal organs, the pressure wave will do extensive damage to organs as it moves through the body, to be stopped at surface of the impacted cavity opposite the point of entry by the surrounding skin and flesh. The elasticity and strength of surface muscle, bone and skin structure, combined with the slowing of the pressure wave, causes the pressure wave to recoil back toward the point of entry.

Figure 13:
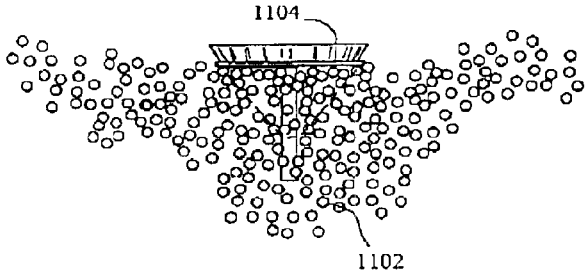
FIG. 13 illustrates a latter stage in which the pressure wave has subsided and the core particles are dispersing radially and in advance of the actuator.

It is the pressure wave created by the projectile's momentum that maintains the core particles 804 within the precise formation behind the actuator 806. As expansion occurs the pressure wave dissipates and becomes insufficient to make a path for the actuator 806. That is, when the air resistance dampens the forward movement of the actuator 806, as illustrated in FIG. 13, the particles begin to radially disperse. When the projectile does not contact a secondary target, the particles 804 will disperse due to the air resistance preventing the particles from traveling a substantial distance. Once the particles have been slowed due to air resistance, as illustrated in FIG. 13, the particles act as non-lethal individual particles. This dispersal must occur within a zone that is from about seven feet to within about ten feet from the point of initial impact.)

The expansion of the core particles starts immediately upon peeling away of the hull, however, to only a limited extent. The pressure wave leads, followed by the actuator, and core particles. The core particles tend to stay in a cohesive group initially, preferably for about three to six feet. The projectile design is such that the pressure wave dissipates rapidly and after travel through the initial zone in which the cohesive mass of particles form a unitary lethal mass, the particles are not tightly packed around the centering stem of the actuator and the actuator no longer travels along a straight trajectory.

As stated heretofore, the speed of the peel back is critical. FIGS. 11 and 12 show what happens to the core particles 1102 when the peel back of the hull 1100 is partial, or too slow, thereby preventing simultaneous release of the core particles 1102. When the hull 1100 passes through the initial impact area and remains in the configuration illustrated in FIG. 11, a portion of the core particles 1102 will remain within the hull 1100. If the hull 1100 continues to slowly peel back, moving into the configuration of FIG. 12, the particles 1102 start to exit between the actuator 1104 and the hull 1100, since the actuator 1104 is being slowed by the stem 1106, still retained within the particles 1102. This causes the particles 1102 to immediately start dispersing, spreading laterally, while degrading from a unitary mass to independently acting particles. The partial or slow peeling of the hull results in a lengthening of the secondary zone and increased instability of the actuator 1104.

The core particles within inches of leaving the hull 1100 reach the final broad radial dispersion illustrated in FIG. 13. In a slow, or uncontrolled, peel back, the distance between initial impact and the final broad radial dispersion is undeterminable due to the unpredictability of the separation. This can also occur if the hull tears or splits due to structural irregularities, as the particles will disperse through the tears in the hull in an uncontrolled manner, and will no longer act as a unitary mass.

Figure 14:
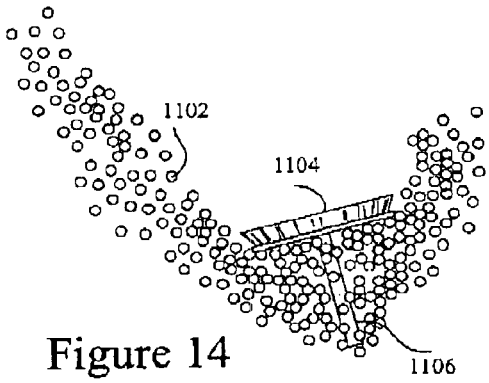
FIG. 14 illustrates a side view of the core particle dispersal when the hull peel back is too slow

It should be noted, however, that planned splitting of the hull, due to predetermined scoring of the hull materials, will cause the hull to split. In this embodiment, however, the scoring at a depth that will enable the split to occur in a timed manner to release the core particles in a controlled manner. FIG. 14 illustrates the continued path of the core particles 1102 pellets when the peel back is too SLOW. In the event of a tearing of the hull, the dispersal would be similar but would be in an inefficient and irregularly shaped star burst form, when viewed three dimensionally.

Although the broad radial dispersal of FIG. 13 is the desired end point, the projectile as disclosed herein, does not reach that point until seven (7) to ten (10) feet after leaving the hull. The slow hull peeling illustrated in FIGS. 11 and 12 would make the projectile ineffective for a secondary impact if it had to pass through an initial shield, such an auto windshield or residential partition wall.

EXAMPLE I

The target was a residential type interior partition wall with a single layer of one half inch thick (½") gypsum board on each side of a standard stud wall. The projectile was a shell having a mass of 7000 small pellets as core particles confined within a hull. The leading, open end of the hull, was closed by a thumbtack like actuator. During the penetration of the wall the hull peeled back, releasing the actuator and the mass of particles. For a distance of about three feet, the mass of particles traveled in a confined zone, as an expanding but unified mass of particles. The mass of core particles had a center core of dense packed particles with a spreading fringe of individual particles. At the end of three (3) feet, the particles had a radial dispersion diameter of about two inches. The pressure wave then dissipated to the point where drag set in and at a distance of about seven (7) to about ten (10) feet, the intermediate zone of the pellets expanded to form a large diameter zone of less lethal individual acting pellets. Impact with the pellets against a target just beyond ten (10) feet from the point of initial impact, could cause abrasion but would not be lethal.

EXAMPLE II

The targets were seventeen (17) to eighteen (18) pound whole pork shoulders. A one-inch thick plywood sheet barrier was placed 36 inches behind the shoulder directly within the line of fire. The aim point was the heavy muscled area just over the shoulder joint itself and would create a projectile path from the outside of the shoulder toward where the shoulder would attach to the animal.

Using several different types of conventional ammunition, the projectiles passed through each pork shoulder and on through the plywood barrier.

In the test firing using the disclosed projectile the one inch plywood sheet barrier was replaced with a ½ inch thick piece of sheetrock. It was determined that if the projectile, or any part of the pork shoulder penetrated the sheetrock, that configuration of the projectile would be considered a failure.

Using the projectile as disclosed herein, the shoulder joint was cleanly separated and blew through a large hole in the back of the shoulder. The paper on the surface of the sheetrock was slightly cut from either the projectile casing or a bone fragment but was otherwise undamaged. Neither the joint bone or cartilage material was marred by the projectile or core particles. Forensic dissection of the shoulder later reviled that the vast majority of core particles had expended their energy inside the shoulder and stopped before reaching the joint itself. The indication was that the shoulder joint had been cleaved from the rest of the bone structure by a pressure wave that had been built up inside the pork shoulder and preceded the expanding projectile through the impact area.

Under normal circumstances, neither the casing nor the bone would have passed through the body due to the viscosity of a living body. Since the pork shoulder consists of dry tissue, and the viscosity is reduced, the dry tissue and bone "bunched" behind the actuator, exiting slightly at the back of the shoulder. Surprisingly, the actuator is almost perfect after impacting the eight-inch thick pork shoulder. The pressure wave blows out an area about four times that of the original projectile diameter.

EXAMPLE III

For example, in the case of a steel drum filled with water and having a 10 inch diameter and 18 inch high, of a fairly high gauge steel, the impact of the projectile of the present invention rips out the front but does not effect the back wall. There is a rebound of the pressure wave, that is, a water hammer effect.

The rebound hydraulic shock can be four times the impact of the initial pressure wave. The present invention projectile, unlike prior art projectiles, produced large bulges at the side and top of the steel drum, but no exit hole. The shock wave does massive damage, and the blunter the nose and the faster the expansion, the greater the shock wave.

A penetrating bullet takes the shock wave with it through the exit opening. A full metal jacket projectile has a very high penetration force and will pass cleanly the same type of container, creating minimal budlging and only a small entranced and exit hole. Thus, the diameter of the trauma zone is very small. In the case of the penetration of a heart it may take an extended period of time for the target to succumb to the wound, due to bleeding. The projectile of the present invention, however, can produce an actual projectile expansion of four (4) to five (5) inches in diameter and a highly destructive ten inch diameter shock wave. Since the projectile does not exit the body there is a shock wave rebound and a huge trauma zone.

EXAMPLE IV

In order to determine the lethal range of the core particles after encountering an initial impact area, two layers of denim placed three (3) inches in front a sheet of plywood. The disclosed projectile was shot through an impact media ten (10) feet in front of the denim and plywood backstop. If the core particles caused any substantial damage to the plywood, or deeply embedded into the plywood, the test was considered unsuccessful. When the core particles were slightly embedded into the plywood and could be easily brushed off, the test was considered successful.

The above tests would also be applicable to different distances and the distance adjustments would be obvious to those skilled in the art when read in conjunction with this disclosure.

FIG. 15 illustrates a preferred embodiment of the hull 1500, in which the hull wall 1502 is gradually tapered. The wall 1502 thickness is greater at the base edge than at the leading edge or open end. This design is used to precisely control the rate of peel back of the hull 1502. By increasing the overall thickness the hull 1502, the peel back rate will be slowed and, conversely, narrowing the thickness will increase the rate of peel back. The taper enables the peel back to start quickly while the thicker bottom maintains the necessary rigidity. If the hull has a uniform thickness, the initialization of the peel back can be too slow the effectively release the core particles simultaneously. The peel back rate must be equal to that of the velocity of the projectile in order to provide the controlled release. Generally the peel back rate is between about 0.0005 and 0.001 seconds. Therefore, as the velocity of the projectile is changed, through projectile size, power type or other customizations, the peel back rate is adjusted accordingly.

Another method of controlling the peel back rate is to score the hull. The number and depth of the score lines directly affects the rate of peel back. Although this is not as reliable as tapering the hull, as too many scores or too deep a scoring will cause the projectile to explode upon first impact, there are specific situations where this would be of value. Scoring the hull deeper than 50% of the hull thickness over compromises the hull.

The actuator design is chosen to facilitate the controlled flight of the core particles, or pellets. As illustrated in FIG. 16, an actuator 1550 with a conical region 1506 that merges at its apex end with a longitudinal stem 1504, has been found to prevent the actuator lead surface 1502 from shearing away on impact. If the lead surface 1502 shears upon impact, the core particles continue to travel as a unitary mass for an extended period of time, thus extending the secondary lethal zone well beyond the preferred maximum distance of ten feet required in this embodiment. Additionally, the without a conical region, the stem can break through the front surface and be propelled forward similar to a slug. This configuration would be used in embodiments where the secondary lethal zone is extended, in a controlled manner, to meet specific law enforcement needs.

The optimum cone angle to achieve the three (3) to seven (7) foot lethal zone is about 40° to 60° from the centerline and preferably in the range of 55' to 58° from the centerline. The lethal zone can be adjusted by changing the cone angle, peel back rate and core particle size. For example, a 40° angle almost eliminates the lethal secondary zone, as the energy of the core particles dissipates immediately. Having an angle of less than 10° doubles the lethal zone if all other factors are the same. The actuator 506 of FIG. 7 would be an example of an extended lethal zone.

FIG. 17 illustrates an actuator 1570 that has a lesser conical region 1572 than the embodiment of FIG. 16. Although a lesser angle is used for the conical region 1672, the stem 1574 has a wide diameter to prevent the stem from penetrating the actuator face 1576 and continuing forwarding as a slug. The actuator 1600 illustrated in FIG. 18 has a conical region 1602 of less than maximum diameter and the use of a narrower stem 1604. Although the narrow stem 1604 is not recommended for applications with a short lethal range, it can be advantageous in specific applications, as will be evident to those skilled in the art. The wide stem also keeps the mass of the core particles away from the actuator mid-point, minimizing the tendency of the core particles to penetrate the center of the actuator head upon impact. Such central penetration can result in a random dispersion of particles.

The spherical core particles can be substituted with fragmented plates that will shred whatever surface they come in contact with. This can be advantageous as it will more effectively penetrate the sheet metal body panels of an automobile, shred the interior, and not exit the other side. The same result is achieved when the spherical core particles are replaced with washer type plates. It should be noted that solid flat plates will not provide the same result. Without the center hole, the flat plates turn on edge and will travel for long distances. The center hole creates aerodynamic instability causing the plates to flip at high rotational speeds decreasing their range of flight and increasing the damage as they rotate.

Figure 25:
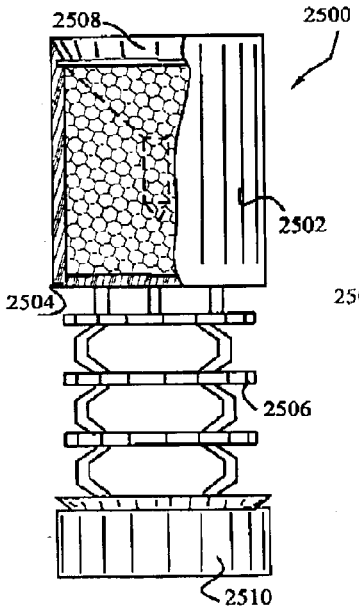
FIG. 25 is a cutaway side view of an alternate projectile embodiment using a sliding hull.
Figure 26:
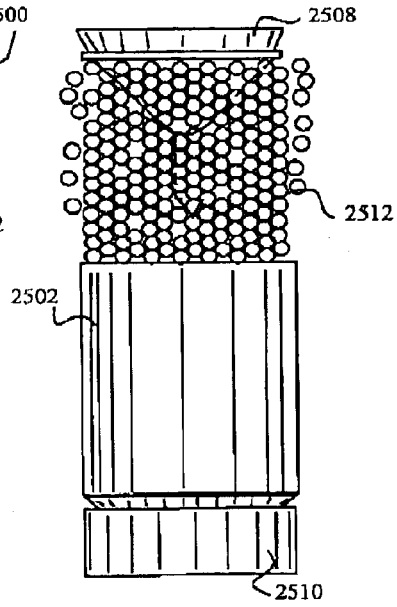
FIG. 26 is a side view of the hull of FIG. 25 with the hull slid into the particle release position.

An alternate to the foregoing peel back method is illustrated in FIGS. 25 and 26 in projectile 2500 wherein the hull side 2502 is scored along the base score line 2504, providing a weakened breaking point. In this embodiment, the wad 2506 has a diameter smaller than that of the hull side 2502 to enable the hull side 2502 to slide over the wad 2506 and rest on the gas seal 2510. The score line 2504 fails under pressure and, as it slides back in response to the air pressure, the actuator 2508 and core particles 2512 are released.

Figure 27:
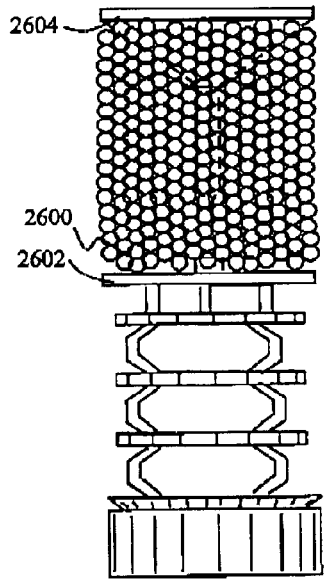
FIG. 27 is a side view of an alternate embodiment using a bonding agent to adhere the core particles.

In FIG. 27 an alternate embodiment uses a bonding agent to maintain the core particles 2600 in a consolidated cylindrical form. The conventional crush section 2602 serves as a base unit while the actuator 2604 serves as a top portion. The actuator 2604 works in the same way as previously described. Upon initial impact the bonding agent holding the core particles in a cohesive form shatters, thereby releasing the core particles 2600 to follow the actuator 2604 as described herein. Alternatively the actuator can be eliminated and the core particles bonded into a cylindrical unit affixed to the crush section. As stated above, upon impact the bonding agent would shatter, releasing the core particles. This embodiment would not have the control of expansion after impact provided by the foregoing embodiments incorporating the actuator, however in specific applications this embodiment could provide advantages.

The use of a blow mold grade low density polyethylene has been found to provide a hull material that will allow the hull to peel back completely, without tearing, and at the desired rate. The actuator is preferably formed from high density polyethylene. The use of a very rigid polymer or other material, such as a carboxylate, is not preferred, because of the tendency to be too rigid on impact.

It should be noted that for simplicity in description, the term shot gun shell is used herein as representing the primary application of the ballistic projectile of the present invention. However, the principles also apply to handgun ammunition and other types of ballistic projectiles.

What is claimed is:

1. The method of impacting a target with a projectile, said projectile comprising an absorption zone, a hull, a mass of core particles within said hull and a radial dispersion control actuator, said actuator being releasably fixed to an impact end of said hull and said absorption zone being upstream of said core particles, comprising the steps of:

a. impacting said target with said hull containing said actuator and said mass of core particles, b. releasing said actuator and said mass of core particles from said hull during a first impact, said actuator maintaining said mass of core particles as a lethal unitary mass, on a substantially straight trajectory behind said actuator, for a first predetermined distance after said first impact, c. radially dispersing said lethal unitary mass over a second predetermined distance to produce a mass of non-lethal individual particles.

2. The method of claim 1, wherein said hull peels back away from said mass of core particles at a rate substantially equal to that of the velocity of the projectile thereby maintaining substantially all of said lethal unitary mass in a confined mass behind said actuator and providing a controlled, first predetermined distance of lethality beyond said first impact.

3. The method of claim 1, wherein a secondary impact of said lethal unitary mass with a target is preceded by a shock wave.

4. The method of claim 1, further comprising the step of maintaining said lethal unitary mass, for said first predetermined distance, beyond said first impact with a lethal impact substantially equal to that of a unitary projectile.

5. The method of claim 1, wherein said first predetermined distance is up to about six feet beyond said first impact.

6. The method of claim 1, wherein said first predetermined distance is up to about three feet beyond said first impact.

7. The method of claim 1 wherein said first predetermined distance is determined by said actuator configuration.

8. A method of controlling the release of energy from a fired projectile, comprising the steps of:

a—releasing from said projectile, during an initial impact, a radial dispersion control actuator leading a unified, cohesive structure of individual particles, b—maintaining said individual particles in said unified, cohesive structure behind said actuator for a first predetermined distance, c—expanding said unified, cohesive structure into a increasingly less unified structure over a second predetermined distance, d—radially dispersing said structure, after said second predetermined distance, into discrete non-lethal particles.

9. The method of claim 8 further comprising the step of said unified, cohesive structure functioning as a slug in step (b); acting like a slug of substantially increased diameter in step (c); and dispersing into non-lethal discrete particles in step (d).

10. The method of claim 8, further comprising the step of step (c) occurring at a distance between about three feet and about six feet from said initial impact.

11. The method of claim 8 further comprising the steps of:

a—confining said particles in a hull b—peeling back and away said hull from said particles, during said first impact, at a predetermined peel back rate, wherein said predetermined peel back rate produces a controlled rate of release of said particles immediately subsequent to said initial impact.

12. The method of claim 11 wherein said predetermined peel back rate is substantially equal to the velocity of said projectile.

13. The method of claim 11, wherein said hull is configured to peel back and release said unified, cohesive structure of individual particles on the order of about one ten thousandth of a second.

14. The method of impacting a target located beyond a first impact zone with a projectile, said projectile comprising an absorption zone, a hull, a mass of core particles within said hull and a radial dispersion control member, said radial dispersion control member being releasably fixed to said hull at an impact end and said absorption zone being upstream of said core particles, comprising the steps of:

a—impacting a first impact zone with said projectile, b—peeling said hull back upon itself during said impact, and releasing said radial dispersion control member and said mass of core particles, said radial dispersion control member and said mass of core particles generating a pressure wave in advance of said mass of core particles, said redial dispersion control member maintaining said core particles in a unified mass for a first predetermined controlled distance after penetration of said first impact zone, c dispersing said projectile core particles in a progressively expanding pattern such that said core particles no longer act as a unitary projectile and travel as substantially discrete individual particles, wherein impact with a target within said first predetermined distance is equivalent to a lethal unitary projectile and impact beyond said first predetermined distance is a non lethal plurality of individual impact.

15. The method of claim 14, wherein said core particles substantially start passing said radial dispersion control member after traveling at least about six feet from said first impact zone.

16. The method of claim 14, wherein said radial dispersion control member has a stem member, said stem member being surrounded and controlled by said mass of projectile core particles, whereby said mass of projectile core particles are maintained in a substantially unified mass.

* * * * *